US010677436B2

(12) United States Patent
Schorr, III

(10) Patent No.: US 10,677,436 B2
(45) Date of Patent: Jun. 9, 2020

(54) REMOTE CONTROL SWITCH FOR ARM-MOUNTED FLASHLIGHT

(71) Applicant: Jerome Otto Schorr, III, Bel Air, MD (US)

(72) Inventor: Jerome Otto Schorr, III, Bel Air, MD (US)

( * ) Notice: Subject to any disclaimer, the term of this patent is extended or adjusted under 35 U.S.C. 154(b) by 0 days.

(21) Appl. No.: 16/398,973

(22) Filed: Apr. 30, 2019

(65) Prior Publication Data

US 2019/0331328 A1 Oct. 31, 2019

Related U.S. Application Data

(60) Provisional application No. 62/664,516, filed on Apr. 30, 2018.

(51) Int. Cl.

| | |
|---|---|
| ***F21V 23/04*** | (2006.01) |
| ***F21V 21/08*** | (2006.01) |
| ***F21L 4/04*** | (2006.01) |
| ***F21L 4/02*** | (2006.01) |

(52) U.S. Cl.

CPC ..... *F21V 23/0435* (2013.01); *F21L 4/027* (2013.01); *F21L 4/045* (2013.01); *F21V 21/08* (2013.01); *F21V 23/0421* (2013.01)

(58) Field of Classification Search

CPC . F21V 23/0435; F21V 21/08; F21L 4/00–085
See application file for complete search history.

(56) References Cited

U.S. PATENT DOCUMENTS

| | | | |
|---|---|---|---|
| 455,972 | A | 7/1891 | Oudin |
| 914,975 | A | 3/1909 | Radley |
| 1,015,715 | A | 1/1912 | Schindler |
| 1,173,269 | A | 2/1916 | Heidemann |
| 1,200,403 | A | 10/1916 | Weyer |
| 1,267,436 | A | 5/1918 | Martin |
| 1,532,493 | A | 7/1921 | Ivie |
| 1,553,860 | A | 9/1922 | Hopper |
| 1,504,980 | A | 12/1923 | Schultz |
| 1,754,570 | A | 2/1929 | Pickett |
| 1,769,241 | A | 7/1930 | Stephani |
| 2,024,281 | A | 3/1935 | Gaskin |
| 3,112,889 | A | 12/1963 | Marmo et al. |
| 3,638,011 | A | 1/1972 | Bain et al. |
| 3,811,684 | A | 5/1974 | Tredway |

(Continued)

FOREIGN PATENT DOCUMENTS

| | | | | |
|---|---|---|---|---|
| DE | 102012022420 A1 * | 6/2014 | ..... | F21L 4/00 |
| JP | 2013145658 A * | 7/2013 | | |

*Primary Examiner* — Mariceli Santiago

(74) *Attorney, Agent, or Firm* — Royal W. Craig; Gordon Feinblatt LLC

(57) ABSTRACT

A remote switch device for an arm-mounted electrical lighting accessory, such as a flashlight, may be securable to a finger of a user. The switch device can include a remote control unit in electrical contact with the end of a flexible cable. The remote control unit can include an integral finger mount for attachment to a finger of the user. The flexible cable can include one end in electrical contact with the remote control unit and a second end in electrical contact with a first connector adapted for being electrically connected to a complementary second connector on the arm-mounted electrical lighting accessory.

19 Claims, 4 Drawing Sheets

(56) References Cited

U.S. PATENT DOCUMENTS 4,422,131 A 12/1983 Clanton et al.
4,425,600 A 1/1984 Barnhart
4,521,832 A 6/1985 Barbour
4,788,631 A 11/1988 Fuller
5,086,378 A 2/1992 Prince
5,124,892 A 6/1992 Lambert
5,154,506 A 10/1992 Leard
5,183,324 A 2/1993 Thomas
5,255,167 A * 10/1993 Toussaint ..... F21L 4/06 359/354
5,283,722 A 2/1994 Koenen et al.
5,345,368 A 9/1994 Huff
5,365,213 A 11/1994 Paull et al.
5,448,458 A * 9/1995 Smyly, Jr. ..... F21L 4/00 362/103
5,450,293 A 9/1995 Hoffman
5,535,105 A 7/1996 Koenen et al.
5,781,511 A 7/1998 Yasukawa et al.
5,816,676 A 10/1998 Koenen Myers et al.
6,213,619 B1 4/2001 Yu
6,270,231 B1 8/2001 Kerr
6,529,121 B2 * 3/2003 Bush ..... A41D 19/0157 340/321
6,592,235 B1 7/2003 Mayo
6,709,142 B2 3/2004 Gyori
6,892,397 B2 5/2005 Raz et al.
6,902,289 B1 6/2005 Smith
7,013,490 B2 3/2006 Senter
7,152,248 B2 12/2006 Ziemer
7,434,955 B2 10/2008 Vickers et al.
7,441,918 B2 10/2008 Kim
7,819,544 B2 10/2010 Thompson et al.
8,038,310 B1 10/2011 Hale et al.
8,303,129 B1 11/2012 Thielen
8,550,648 B2 10/2013 Smith
8,562,165 B2 10/2013 Thompson et al.
8,727,556 B2 5/2014 Swan
2004/0223321 A1 * 11/2004 Crowley ..... F21L 4/06 362/103
2008/0062676 A1 3/2008 Masuda
2010/0096486 A1 4/2010 Yang
2014/0291556 A1 * 10/2014 Bowers ..... F21L 4/00 250/504 R
2018/0011283 A1 4/2018 Eivaz
2019/0216144 A1 * 7/2019 York ..... F21V 21/14

* cited by examiner

REMOTE CONTROL SWITCH FOR ARM-MOUNTED FLASHLIGHT

CROSS-REFERENCE TO RELATED APPLICATION(S)

The present invention derives priority from U.S. Provisional Patent Application No. 62/664,516 filed 30 Apr. 2018.

BACKGROUND OF THE INVENTION

1. Field of the Invention

The present invention relates generally to arm-mounted flashlights and, more particularly, to a wrist mount that is for mounting a conventional flashlight and with a distal fingertip remote control that is attached to the user's finger to allow the user to power the light unit on/off and/or switch between multiple lighting display modes.

2. Description of the Background

Flashlights are commonly used in a wide variety of situations to illuminate areas where normal lighting is not readily available. The conventional solution is to hold a flashlight or use a headlamp to create the desired lighted area. Although wrist-mounted flashlights and holsters to attach handheld flashlights to the arm are also available, they are less commonly used in most situations. These devices all require the user to fully occupy at least one hand with the operation of the flashlight when they want to turn it on, off, or cycle through different lighting modes.

Many people including military personnel, police, firemen, campers, hikers, mechanics, fishermen, hunters, electricians, etc. often find themselves in a situation where they need a flashlight but need to use the hand that would otherwise hold and operate the flashlight. For example, in the case of a policeman, he may need to use a flashlight while holding a firearm with both hands. Both hands may be necessary to keep a steady aim on the intended target. Unless he removes at least one hand from the firearm, he would have difficulty in activating the flashlight. In another example, a camper may be assembling a tent in the dark and need to use a flashlight while holding multiple parts of the tent assembly. The camper can continue to use both hands while activating the flashlight as he assembles the tent. In yet another example, various types of switch apparatus are used for firearm-mounted flashlights with tail cap switches or pressure actuable tape switches. The flashlight beam is limited to the parallel path of the firearm and can only be used while the firearm is present.

It would be greatly desirable to allow such persons to use a flashlight without removing any hands from the current task. There are a number of patents that show wrist-mounted, hand-mounted and arm-mounted flashlights. For example, U.S. Pat. No. 4,788,631 improves on the standard wrist-mounted flashlight by incorporating a sliding lens with white and red sections that engage the electrical contact with the batteries and energize the light.

U.S. Pat. App. No. 20080062676 incorporates lighting components that can be easily attached or detached from a user's fingers allowing the light to illuminate the area around the user's hand. Light gloves have also been introduced in Japanese Pub. No. 2004-316050, Japanese Utility Model Reg. No. 3057778, Japanese Pub. No. HEI 7-323097, and Japanese Utility Model Reg. No. 3114125 that are configured so that the lighting components such as fairy lights or light-emitting diodes (LEDs) are attached to the finger parts of the gloves. As a result, these lighting devices provide varying amounts of light in the vicinity of the hand, but none of them provide an easy single-finger mounted switch to remotely operate a wrist-mounted flashlight with a significant light source while continuing to work without interrupting the hand from its normal activity.

There have been several efforts to improve flashlight systems that include flashlights and signaling lights into hand, arm and wrist attachments. For example, U.S. Pat. Nos. 1,173,269, 1,267,436 and 5,365,213 include bulky devices with activating switches that are incorporated into gloves, wrist attachments and larger body attachments that require excessive components and limit the use and operation of the devices. As a result, none of these provide an easy finger mounted switch to remotely operate an arm-mounted flashlight with a significant light source while continuing to work without interrupting the hand from its normal activity.

There have also been efforts to improve flashlights that attach to firearms and their associated rail mounting systems. For example, U.S. Pat. No. 7,441,918 B2 improves on the standard firearm mounted flashlight by including a remote switch that attaches to the rail structure connected to the firearm. The remote switching apparatus allows someone who is holding a firearm to more effectively operate the flashlight while also operating the firearm. As a result, this flashlight system is also deficient since the firearm and its secured attachments are all required to be present to maintain operation of the flashlight.

In general, the prior art suffers from a common deficiency in that they require the user to occupy one hand to turn the beam on or off or to otherwise control the beam's color, diffusion angle, etc., and the beam must be diverted. What is needed is a remote control switch device for an arm-mounted flashlight that is securable to a user's finger to allow the user to operate the flashlight via their fingertips, and thereby illuminate a target while leaving both hands free to work on the target, and moreover to keep the beam directionally trained on the target while controlling the beam. The prior art for wrist or hand/arm-mounted flashlight systems also commonly force the user to utilize specific lighting elements that are incorporated into the available device. Different use requirements, situations and operator personal preferences often direct the selection of particular flashlights and types of switches.

Thus, it would be greatly advantageous to provide a switch device for an arm-mounted flashlight with a method of simple operation via a remote control unit that is attached to the user's finger.

SUMMARY OF THE INVENTION

Objects of the present invention include the following:

It is an object of the present invention to provide a remote control switch device for arm-mounted electrical lighting accessory, such as a flashlight.

It is another object of the present invention to provide a remote electrical push button switch, tape switch or capacitive touch switch and associated housing wherein said switch can attach to the user's finger and can be conductively connected to the arm-mounted flashlight via a flexible cable to a plug that is removably connectable to the flashlight jack, tail cap jack or similar interface with optional pushbutton switch.

It is still another object of the present invention to provide a simple push button or tap mode-select operation switch that a user can operate to select one of a number of flashlight modes by simple depression or touch of the remote control switch attached to the user's finger. The modes may include bright illumination modes, an emergency signaling mode, a rapid disorienting flash mode, other unique lighting modes selected by the user. In some embodiments, the modes may include a mode to operate a single light activation without multiple modes of illumination.

It is still another object of the present invention to provide an optional tail cap assembly that includes a pushbutton switch in addition to the jack for the remote control switch.

It is still another object of the present invention to provide an optional tail cap assembly wherein said remote control switch attaches to the user's finger and is conductively connected to the arm-mounted flashlight via a flexible cable to a plug that is connectable to a tail cap jack or which serves as the tail cap with or without an optional pushbutton switch.

In accordance with the foregoing objects, the invention is an arm-mount for a conventional flashlight and a remote control unit that attaches to the finger for allowing the user to control the flashlight by finger or by the switch in the tail cap assembly. The remote control may allow the user to power the light unit on/off and/or switch between multiple lighting display modes using their fingertips. By providing a means to remotely activate the flashlight, the invention can free both hands of the user or at least all of the fingers except the one used to activate the flashlight. A consumer can use the arm-mounted light of their choice more effectively and economically instead of purchasing limited use items as he or she would have to with the prior art.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a remote control switch device that turns a conventional-style flashlight into a hands-free arm-mounted flashlight with convenient finger-tip activated illumination. The remote control generally comprises a remote switch including housing having a resilient yoke adapted to securely grasp a finger on the user's hand for retaining the housing to the finger. The remote control is wire-connected to the arm-mounted flashlight via a flexible cable, preferably to a plug that is removably or permanently inserted into the tail of the flashlight as a surrogate for the OEM tail cap. The remote control minimally allows the user to power the light unit on/off by thumb and forefinger, but may also allow switching between various lighting colors, diffusion angles/patterns, other display modes or alternate functions. The remote control switch device for an arm-mounted flashlight enables a user to directionally train the beam on the target, use both hands to work on the target, and additionally power the beam on/off, etc. without diverting the flashlight beam from the target.

Figure 1A:
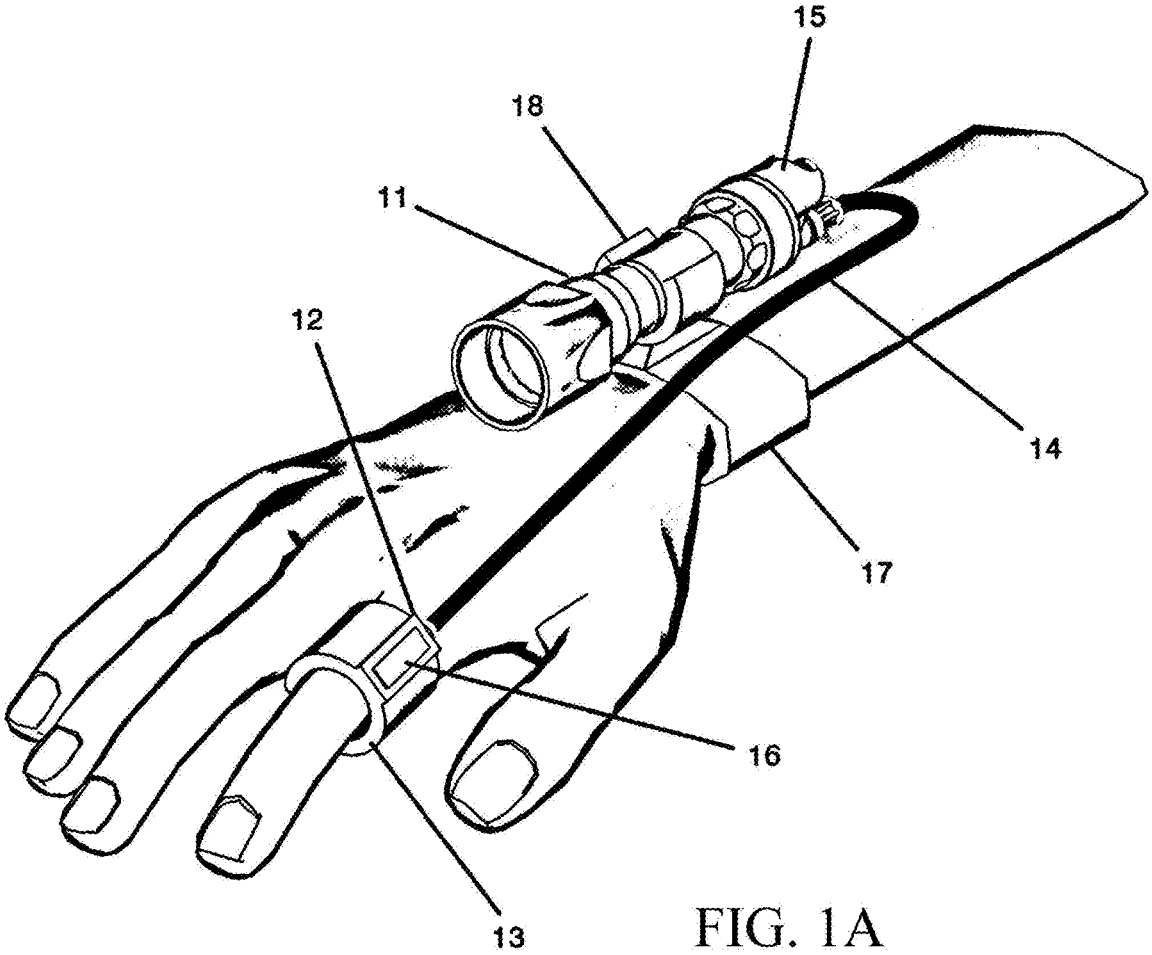
FIG. 1A shows a perspective view of the exemplary switch device for an arm-mounted flashlight secured to a user's finger with remote control switch, flexible cable and flashlight rear or tail cap assembly, all attached to a hand and arm in accordance with the preferred embodiment of the present invention.

FIG. 1A shows an example of a flashlight 11, which may be any conventional flashlight, non-standard flashlight, lighting unit or target illuminator. Flashlight 11 is inserted into a wrist mount 17 and held captive therein atop the wrist and pointing longitudinally. Flashlight 11 is connected to a remote control unit 12 via a flexible cable 14, which may be any suitable electrical cable, preferably an insulated multi-conductor cable, ribbon cable, coiled cable with shape-memory quality, or the like. In an embodiment, the flexible cable 14 connects to the flashlight 11 by a surrogate tail cap 15 that replaces the existing tail cap of the flashlight 11. Alternatively, the flexible cable 14 may connect to the flashlight 11 by a plug-and-receptacle type connection built into the existing tail cap 15 or flashlight 11. The flashlight 11 is attached to a wrist mount 17 and is configured to be secured thereby around the wrist or distal portion of the arm or hand of the user. The wrist mount 17 generally comprises a wrist strap with one or more top-mounted resilient stirrups 18 for holding the flashlight 11 captive thereon or is friction-mounted via straps, rubber, or other methods of control. The flashlight 11 is affixed to the wrist strap by passing it through the stirrups 18 in this example. However, one skilled in the art will understand that any suitable plastic clamping collar, Velcro™, interference fit clamps, buttons, or other suitable means may be used. The remote control unit 12 is configured to be attached to the finger via an annular ring 13, or resilient half-yoke sections or other suitable finger connection. The remote control unit 12 can include a power switch 16 to power the flashlight 11 on/off and may optionally and additionally include switch(es) for switching between multiple lighting display modes, colors and/or diffusion patterns, or other functions.

Figure 1B:
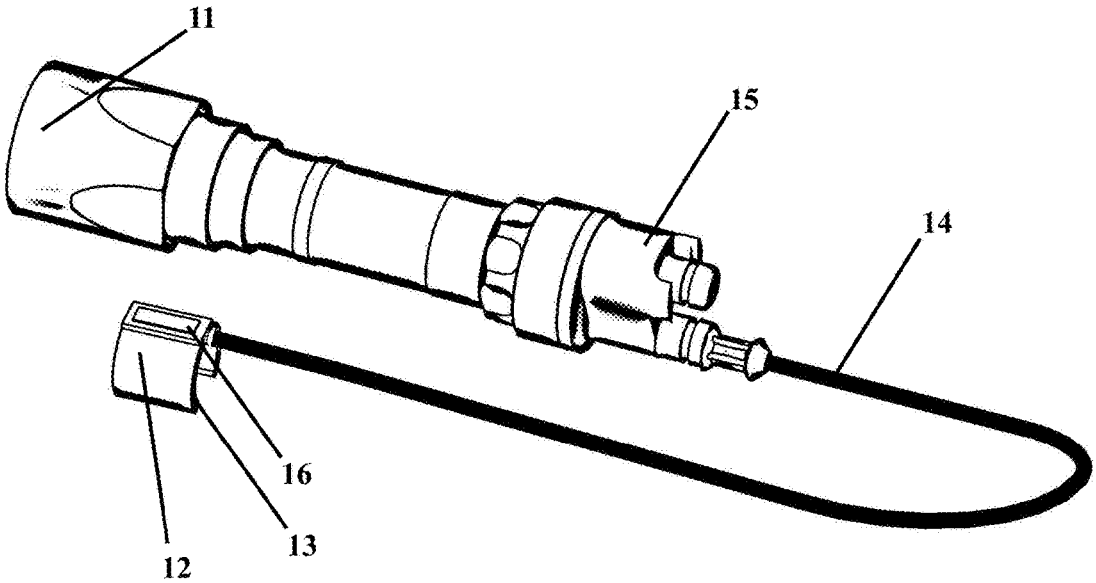
FIG. 1B shows a side view of the exemplary switch device for an arm-mounted flashlight with remote control switch, flexible cable, and flashlight rear or tail cap assembly.

The remote control unit 12 can connect to the flashlight 11 via flexible cable 14. As can be seen in FIG. 1A, the switch 16 on the remote control unit 12 may be operated by pressing with either adjacent finger to power the flashlight 11 on and/or off without disrupting the orientation of the beam emanating from the flashlight 11. FIG. 1B shows a side view of the exemplary switch device for an arm-mounted flashlight with remote control switch of FIG. 1A, without being mounted to a user.

Figure 2:
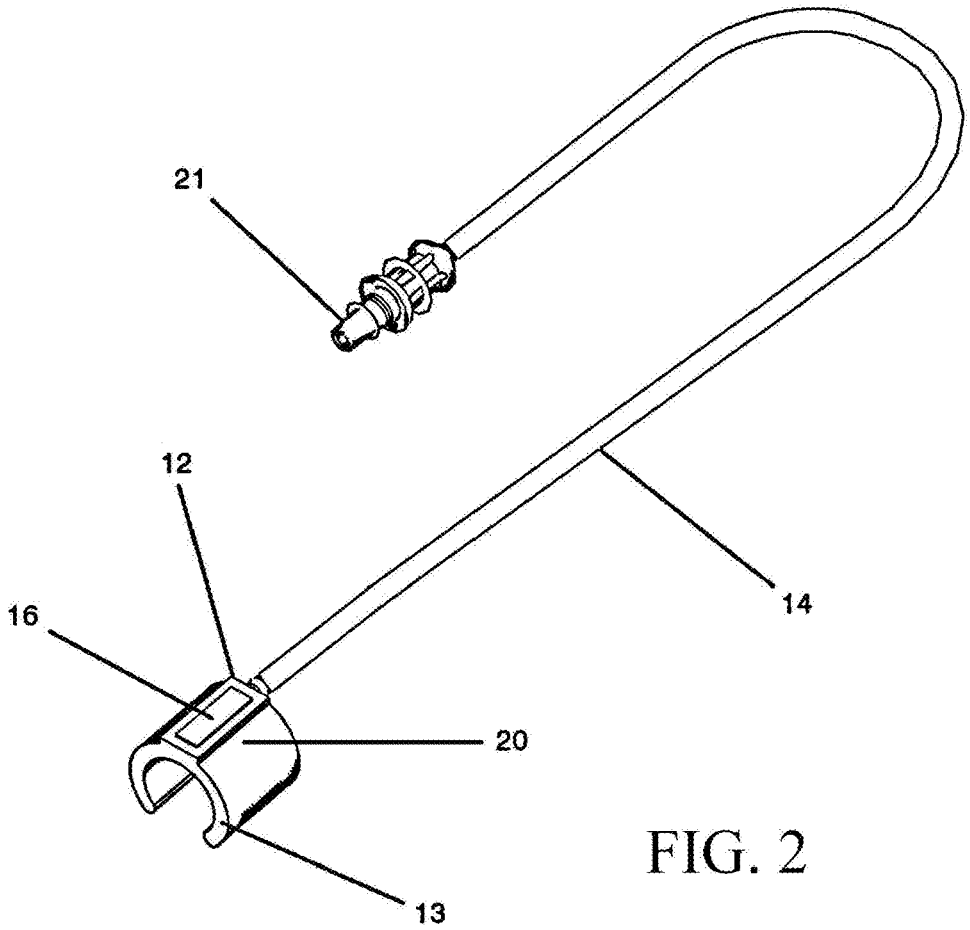
FIG. 2 shows a perspective view of the remote control unit, flexible cable and tail cap assembly plug of the present invention that attaches to an arm-mounted flashlight assembly.
Figure 4:
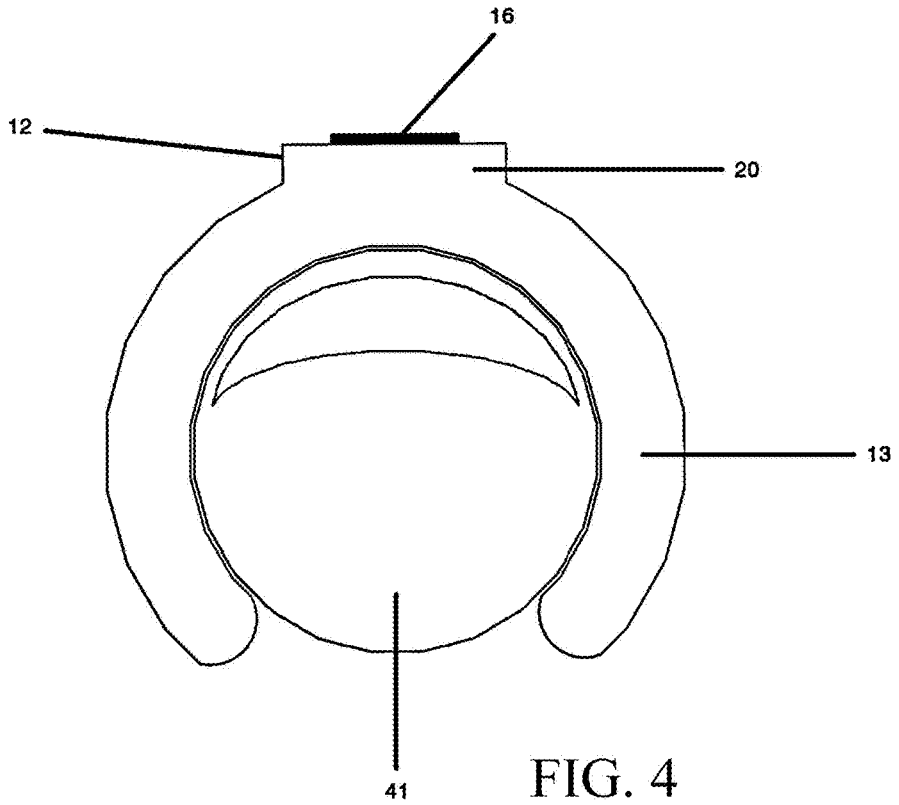
FIG. 4 shows a cross-sectional view of the remote control switch housing mounted to a user's finger.

FIGS. 2 and 4 show detail views of the remote control unit 12 which is preferably mounted atop a resilient two-prong flexible annular ring 13. The remote control unit 12 minimally comprises an enclosed electrical detent switch, tape switch or capacitive touch switch 16 incorporated into a sealed housing 20 attached to the ring 13 that is further configured to be attached to a finger 41. The flexible cable 14 can be electrically connected to remote control unit 12 and is further connected to the flashlight 11 via surrogate tail cap or plug-in-receptacle connection to the tail cap 15. For example, flexible cable 14 can include a first connector to connect to flashlight 11, such as a male plug 21.

Figure 3:
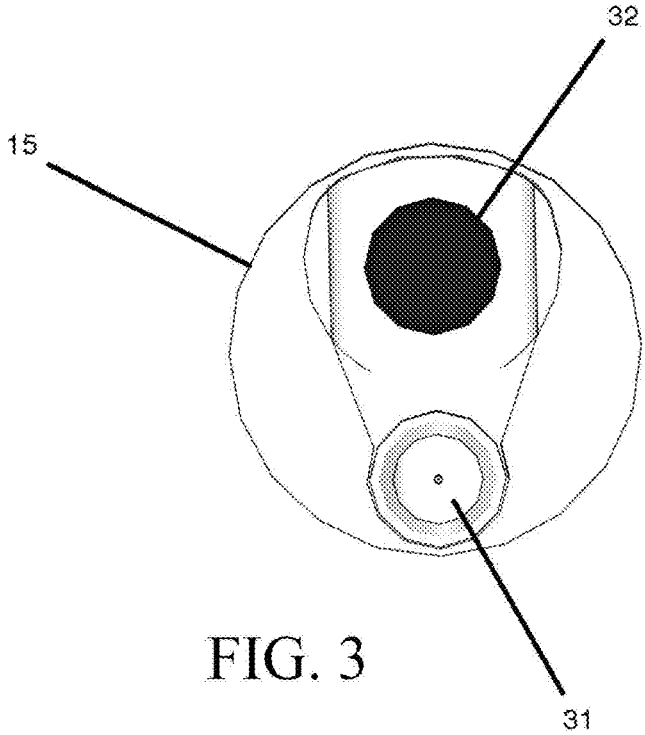
FIG. 3 shows a rear view of the tail cap assembly that includes a flexible cable mounting point and an optional pushbutton.

FIG. 3 shows an exemplary view of a tail cap assembly 15 that allows the first connector 21 of flexible cable 14 to be electrically connected to a complementary second connector 31 of tail cap assembly 15. The connection may be, for example, an optional plug-in-receptacle type connection including a female jack 31 in tail cap assembly 15, to which the remote control unit 12 may be connected via a male plug 21 on flexible cable 14 which is inserted therein. The tail cap assembly 15 may also be hard-wired to the connector device or jack 31 and may screw into the flashlight as a surrogate for the existing OEM tail plug. In addition, however, the tail cap assembly 15 further includes an optional second switch 32, such as a pushbutton detent actuator or other pressure actuatable switch, secured in the tail cap assembly 15.

Figure 5:
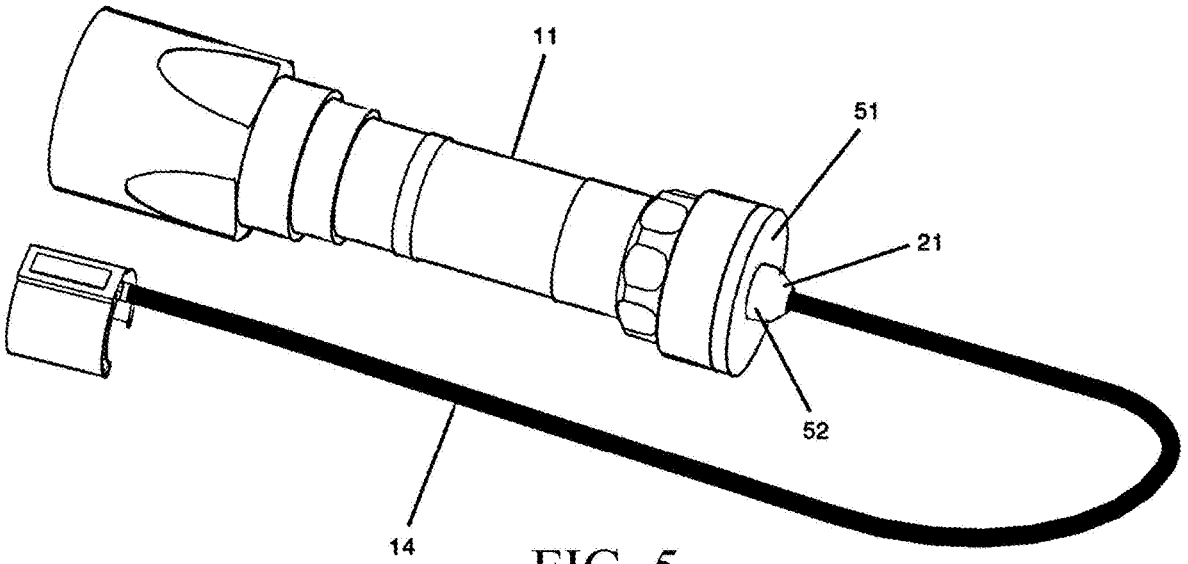
FIG. 5 shows a perspective view of an optional configuration of the switch device for arm-mounted flashlight with remote control switch having a flexible cable, and a removable cable mounting point to the flashlight rear, and without a tail cap assembly.

FIG. 5 shows an alternative embodiment of the invention where there is no separate tail cap assembly 15 that plugs into the flashlight 11. Instead, the flexible cable 14 enters the rear wall 51 of the flashlight 11 via a small coupling receptacle 52 with a connector device or plug 21 where it is impermanently secured.

Figure 6:
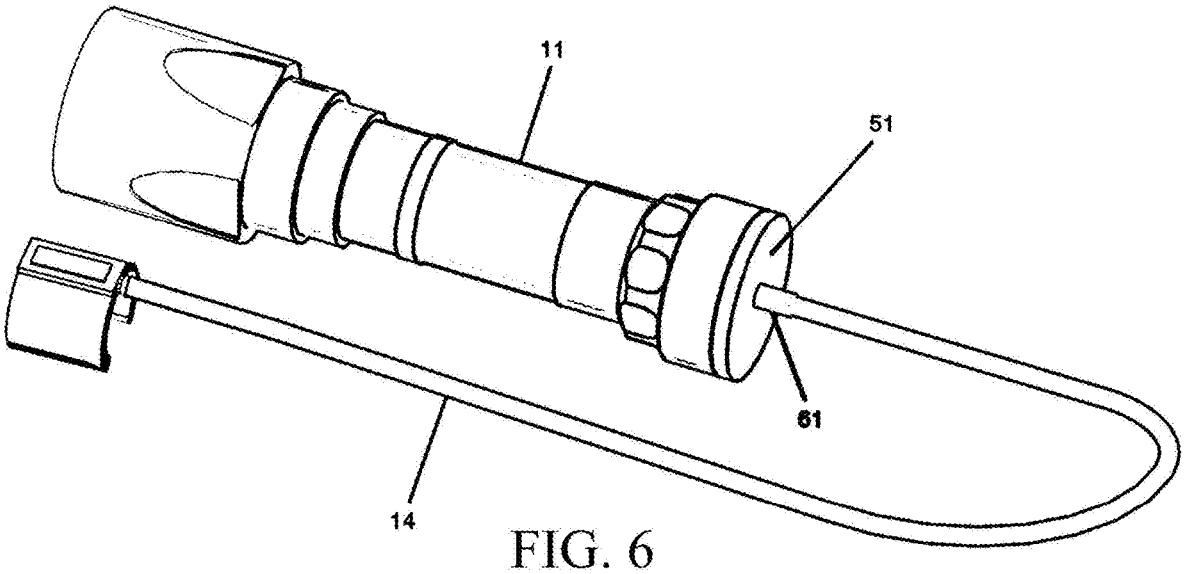
FIG. 6 shows a perspective view of an optional configuration of the switch device for arm-mounted flashlight with remote control switch having a flexible cable with permanent cable mounting point to flashlight rear without tail cap assembly.

FIG. 6 shows another alternative embodiment of the invention where there is no separate tail cap assembly 15 that plugs into the flashlight 11. Instead, the flexible cable 14 enters the rear wall 51 of the flashlight 11 via a small coupling port 61 where it is permanently secured.

In other embodiments of the invention, flexible cable 14 can be connected to flashlight 11 at locations other than a tail cap assembly 15 or rear wall 51. For example, in some embodiments of the invention, flexible cable 14 can be connected to a side, top, front, or bottom of a housing of flashlight 11. More generally, flexible cable 14 can be connected to any location of flashlight 11 that is suitable for the purposes of this invention, such as at a location that is beneficial for commercial manufacturing of flashlight 11, flexible cable 14, control unit 12, or any other component of embodiments of this invention.

Figure 7:
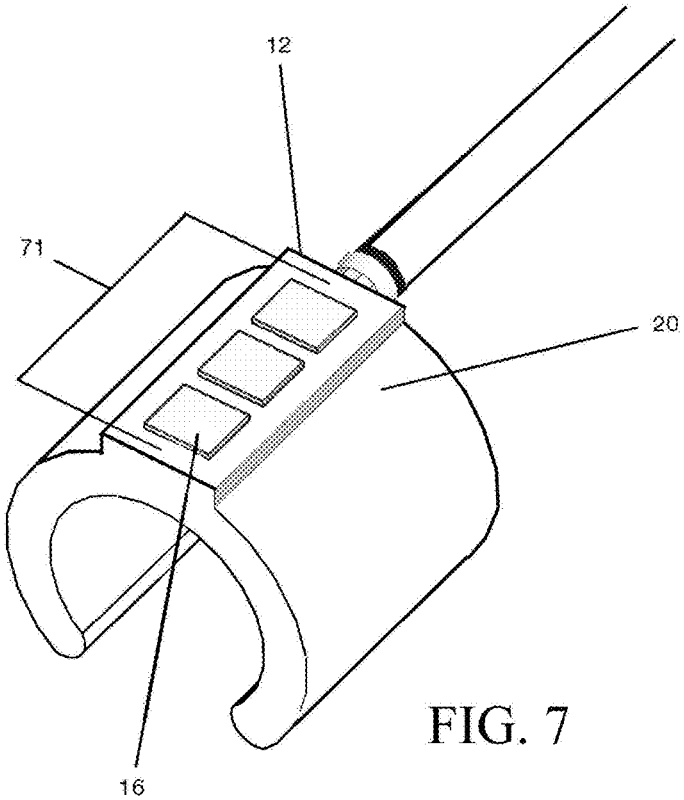
FIG. 7 shows a perspective view of an optional configuration of the remote switch housing with multiple control switches for selecting different flashlight operating modes or alternate functions.

FIG. 7 shows yet another alternative embodiment where the remote control unit 12 is not limited by the use of one button or switch 16 to cycle through various modes. Instead, the singular remote control switch 16 is replaced by multiple remote control switches 71 in the sealed housing 20. Multiple remote control switches 71 allow the user to power the light unit on/off, but may at the same time also allow switching between various lighting colors, diffusion angles/patterns, multiple display modes, or other functions.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. In all such cases, the result is a more aesthetically pleasing or customized for appearance or practical, functional purposes remote control switch for arm-mounted flashlight in a commercially manufacturable configuration that modifies the aesthetics and/or appearance while preserving the integrity and functional structure of the remote switch assembly so as not to depart from established standards.

For the purposes of this disclosure, unless expressly stated otherwise: (a) the use of singular forms of terms include plural forms; (b) the use of the terms "including," "having," and similar terms are deemed to have the same meaning as "comprising" and thus should not be understood as limiting.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A remote switch device securable to a finger for actuating a flashlight having an external connector for connection to a remote control unit, the switch device comprising:

a remote control unit comprising an actuator and an integral finger mount for attachment to a finger of the user; and a flexible cable having one end in electrical contact with said remote control unit and a second end with a mating connector configured for insertion into the external connector of said flashlight for electrical connection to said flashlight.

2. The switch device according to claim 1, wherein said mating connector is a male connector secured to a tail cap assembly of said flashlight.

3. The switch device according to claim 1, wherein said tail cap assembly comprises a pressure actuatable switch.

4. The switch device according to claim 1, wherein said integral finger mount comprises a flexible annular ring having two prongs.

5. The switch device according to claim 1, wherein said actuator comprises one or more switches for performing at least one operation selected from the group consisting of: powering said electrical lighting accessory on or off, selecting a brightness mode, selecting a light color mode, selecting a light diffusion pattern mode, selecting an emergency signaling mode, and selecting rapid disorienting flash mode.

6. The switch device according to claim 1, wherein said integral finger mount comprises one or more switches configured to be operable by a fingertip of said user that is adjacent to said finger of said user.

7. The switch device according to claim 1, wherein said integral finger mount comprises an annular ring and one or more electrical detent switches incorporated into a sealed housing attached to said annular ring.

8. The switch device according to claim 1, wherein said flexible cable is comprised of a flexible shape-memory coil spring cable.

9. A remote switch device for actuating a flashlight, comprising:

a remote control unit comprising an actuator and an integral finger mount configured for attachment of said actuator to a finger of the user;

a tail cap assembly configured for attachment to said flashlight; and a flexible cable electrically connected between said remote control unit and said tail cap assembly.

10. The switch device according to claim 9, wherein said flexible cable is removably connected to said tail cap assembly by a first connector.

11. The switch device according to claim 10, wherein said tail cap assembly comprises a pressure actuatable switch.

12. The switch device according to claim 10, wherein said integral finger mount comprises a flexible annular ring having two prongs.

13. The switch device according to claim 10, wherein said actuator comprises one or more switches for performing at least one operation selected from the group consisting of: powering said electrical lighting accessory on or off, selecting a brightness mode, selecting a light color mode, selecting a light diffusion pattern mode, selecting an emergency signaling mode, and selecting rapid disorienting flash mode.

14. The switch device according to claim 10, wherein said integral finger mount comprises one or more switches configured to be operable by a fingertip of said user that is adjacent to said finger of said user.

15. The switch device according to claim 10, wherein said integral finger mount comprises an annular ring and said actuator comprises one or more electrical detent switches incorporated into a sealed housing attached to said annular ring.

16. The switch device according to claim 10, wherein said flexible cable is comprised of a flexible shape-memory coiled spring cable.

17. A remote switch device for actuating a flashlight having an external female connector for connection to a remote control unit, comprising:

a remote control unit comprising an actuator and an integral finger mount configured for attachment of said actuator to a finger of the user; and a flexible cable electrically connected at one end to said remote control unit and having a mating male connector at another end for connecting to the external female connector of said flashlight.

18. The switch device according to claim 17, wherein said flashlight external connector is on a tail cap assembly of said flashlight.

19. The switch device according to claim 17, wherein said integral finger mount comprises a flexible annular ring having two prongs.

* * * * *